US008909104B2

(12) United States Patent
Shigehiro

(10) Patent No.: US 8,909,104 B2
(45) Date of Patent: Dec. 9, 2014

(54) DEVELOPING DEVICE AND IMAGE FORMING APPARATUS

(71) Applicant: Canon Kabushiki Kaisha, Tokyo (JP)

(72) Inventor: Koji Shigehiro, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 49 days.

(21) Appl. No.: 13/727,724

(22) Filed: Dec. 27, 2012

(65) Prior Publication Data

US 2013/0177339 A1 Jul. 11, 2013

(30) Foreign Application Priority Data

Jan. 10, 2012 (JP) ..... 2012-002195

(51) Int. Cl.
*G03G 15/08* (2006.01)

(52) U.S. Cl.
CPC ..... *G03G 15/0889* (2013.01); *G03G 15/0893* (2013.01)
USPC ..... 399/254; 399/276

(58) Field of Classification Search
USPC ..... 399/276, 254, 256
See application file for complete search history.

(56) References Cited

U.S. PATENT DOCUMENTS 4,389,113 A * 6/1983 Matsumoto et al. ..... 399/276 X
5,153,376 A * 10/1992 Tomita ..... 399/276
8,045,893 B2 * 10/2011 Nakayama et al. ..... 399/254
2006/0062599 A1 3/2006 Shimmura et al.
2007/0104517 A1 5/2007 Shimmura et al.
2013/0108328 A1 * 5/2013 Ariizumi ..... 399/276
2013/0136506 A1 * 5/2013 Sakamaki ..... 399/276 X

FOREIGN PATENT DOCUMENTS

JP 6-51634 A 2/1994
JP 11-84874 A 3/1999
JP 3127594 B2 1/2001
JP 2006-91833 A 4/2006
JP 2007-279250 A 10/2007
JP 2009-288581 A 12/2009
JP 4572861 B2 11/2010
JP 2011-150248 A 8/2011

* cited by examiner

*Primary Examiner* — Sophia S Chen
(74) *Attorney, Agent, or Firm* — Fitzpatrick, Cella, Harper & Scinto

(57) ABSTRACT

According to a representative configuration of the developing device and the image forming apparatus of the present invention, the developing device includes: a developing sleeve which bears developer and conveys the developer to a developing region; a developing chamber which supplies the developer to the developing sleeve; an agitating chamber which forms a circulation path with the developing chamber and collects the developer from the developing sleeve; and a conveying unit (a first conveying screw and a second conveying screw) which circulates and conveys the developer in the circulation path. A spiral groove is formed on a surface of the developing sleeve so as to apply a conveying force to the developer in a rotation axis direction of the developing sleeve opposite to a developer conveying direction of the agitating chamber.

6 Claims, 9 Drawing Sheets

20°
45°
70°
SLEEVE ROTATION DIRECTION
ENLARGED GROOVE SECTION
CONVEYING FORCE DIRECTION
LONGITUDINAL DIRECTION
CIRCUMFERENTIAL DIRECTION
L1
L2
44b2
RIDGE
FURROW
CONVEYING FORCE F2 (LARGE)
CONVEYING FORCE F2 (SMALL)
CONVEYING FORCE F1 (SMALL)
CONVEYING FORCE F1 (LARGE)
RIDGE SURFACE SECTION IN CIRCUMFERENTIAL DIRECTION
RIDGE SURFACE SECTION IN LONGITUDINAL DIRECTION

DEVELOPING DEVICE AND IMAGE FORMING APPARATUS

BACKGROUND OF THE INVENTION

1. Field of the Invention

The present invention relates to an image forming apparatus such as a copying machine, a printer, or a facsimile, and a developing device used therefor.

2. Description of the Related Art

Vertical agitation type developing devices horizontally arranged in parallel are used as conventional developing devices for reducing the size of a full color image forming apparatus. In such a vertical agitation type developing device as illustrated in FIG. 8, a function separation method is adopted in which a developing chamber 41*a* and an agitating chamber 41*b* are vertically disposed, and toner is supplied to a developing sleeve 44 from the developing chamber 41*a* and is collected in the agitating chamber 41*b*. Therefore, toner density nonuniformity and image density nonuniformity resulting therefrom can be prevented, and thus a uniform image having no lengthwise density difference can be obtained.

In the vertical agitation type developing device 4 adopting the function separation method, if the fluidity of developer is varied as a result of a control operation such as T/D control for durability or charging amount adjustment, circulation of the developer may lean to one side in a developing container 41, and the developer may easily stagnate on a scooping portion. Here, T/D denotes a weight ratio of toner relative to developer.

The conveying of developer is very sensitively affected by the fluidity of the developer because the developer is squeezed by a second conveying screw 41*e* while being scooped up from the lower agitating chamber 41*b* to the upper developing chamber 41*a*. If developer stagnation occurs, developer rotates together with the developing sleeve 44 after a developing operation instead of being stripped from the developing sleeve 44 at the downstream side of the agitating chamber 41*b* (corotation phenomenon). If the level of developer stagnation increases, the developing device 4 may overflow with the developer.

A common method used as a countermeasure against such overflow is to form a groove having a depth of several tens micrometers (μm) in the developing sleeve 44 for easily conveying developer. FIG. 9 is a front view illustrating a developing device having a grooved sleeve in the related art. Referring to FIG. 9, a groove is formed at regular intervals around the surface of a developing sleeve 44 of the related art along a longitudinal rotational axis thereof. Furthermore, in a blast method also used as a countermeasure against overflow of developer, glass beads are injected to the surface of the developing sleeve 44 to roughen the surface of the developing sleeve 44. In those cases, since the developing sleeve 44 can convey developer forcibly, it is possible to reduce the amount of developer stagnating on a stripping pole between repelling like poles of a magnet disposed in the developing sleeve 44.

In addition, as a method of stabilizing developer distribution in a vertical agitation type developing device, a return screw is disposed between an agitating screw and a developing sleeve (Japanese Patent Laid-Open Nos. 6-51634 and 11-84874). In Japanese Patent Laid-Open No. 6-51634, when developer is collected to an agitating chamber from a developing region by rotating a return screw and an agitating screw in opposite directions, the amount of developer is large in the vicinity of an upper scooping portion, thereby preventing stripped developer from sticking back to a developing sleeve.

However, in the structure where a groove is formed in a developing sleeve, a corotation phenomenon may occur in which developer is not stripped from the developing sleeve but is rotated together with the developing sleeve after a developing operation.

Further, in the configuration disclosed in Japanese Patent Laid-Open No. 6-51634, all the developer splattered upward by the return screw may not reach the agitating screw but some may return to the developing sleeve. If it becomes difficult to convey developer as the fluidity of the developer is lowered by aging, the scooping portion may scoop developer insufficiently, the return screw may convey the developer insufficiently, and the developer may be collected from the developing sleeve insufficiently, thereby causing a corotation phenomenon.

Furthermore, the configuration disclosed in Japanese Patent Laid-Open No. 11-84874 does not sufficiently cope with the change of the distribution of developer according to the variation of fluidity caused by durability deterioration, T/D variation, and greenhouse environment.

SUMMARY OF THE INVENTION

It is desirable to provide a developing device and an image forming apparatus capable of preventing a corotation phenomenon and preventing stripped developer from attaching back to a developing sleeve even when the fluidity of the developer decreases.

In order to solve the above-mentioned problems, a developing device and an image forming apparatus according to the present invention have the following representative configuration. The developing device include: a developer bearing member which bears developer and conveys the developer to a developing region; a developing chamber which faces the developer bearing member to supply the developer to the developer bearing member; an agitating chamber which forms a circulation path with the developing chamber and faces the developer bearing member to collect the developer from the developer bearing member; a conveying member which circulates and conveys the developer in the circulation path; and a spiral groove which is formed on a surface of the developer bearing member, wherein the spiral groove is helically formed in a direction such that, when the developer bearing member is rotated, the developer borne on the developer bearing member receives a conveying force in a rotational axis direction of the developer bearing member opposite to a developer conveying direction of the agitating chamber.

Further features of the present invention will become apparent from the following description of exemplary embodiments with reference to the attached drawings.

DESCRIPTION OF THE EMBODIMENTS

Figure 1:
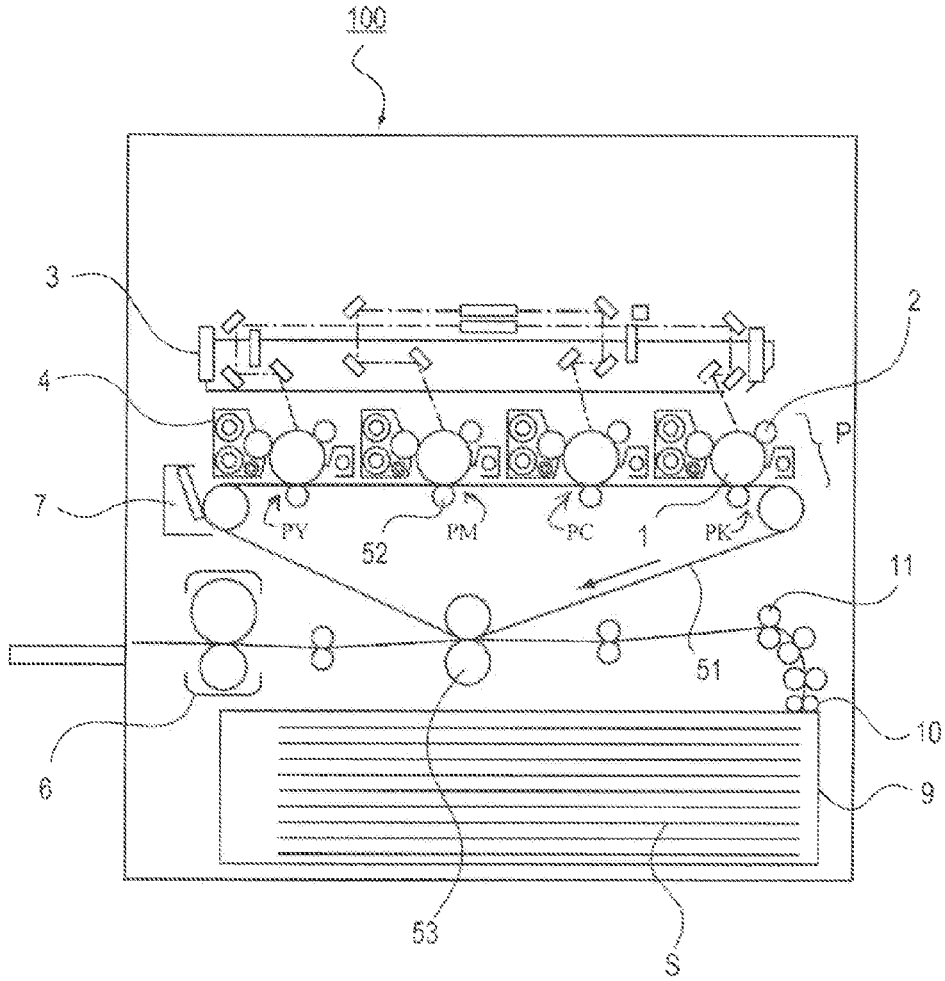
FIG. 1 is a configuration diagram of an image forming apparatus according to a first embodiment.

[First Embodiment] A first embodiment of a developing device and an image forming apparatus according to the present invention will be described with reference to the drawings. FIG. 1 is a configuration diagram of an image forming apparatus 100 according to the present embodiment.

As illustrated in FIG. 1, the image forming apparatus 100 of the present embodiment includes image forming portions P (PY, PM, PC, and PK) for forming images with yellow, magenta, cyan, and black colors. The image forming portions PY, PM, PC, and PK have substantially the same structure except for different developing colors.

In each of the image forming portions P, a photosensitive drum (image bearing member) 1 charged by a charging roller 2 is exposed to light by an exposure device 3 according to an image information signal, and thus an electrostatic latent image is formed on the photosensitive drum 1. The electrostatic latent image formed on the photosensitive drum 1 is developed into a toner image of each color by a developing device 4 using toner. The toner image of each color formed on the photosensitive drum 1 is placed on an intermediate transfer belt 51 at a primary transfer portion (primary transfer nip portion) where the intermediate transfer belt 51 and the photosensitive drum 1 abut onto each other at roller 52, so that the toner image can be primarily transferred to the intermediate transfer belt 51.

A sheet S disposed in a cassette 9 is conveyed by pick-up rollers 10 and conveying rollers 11 to a secondary transfer portion (secondary transfer nip portion) at which the intermediate transfer belt 51 and a secondary transfer member 53 abut onto each other, so that the toner image is secondarily transferred to the sheet S. The sheet S to which the toner image is secondarily transferred is heated and pressurized by a fixing device 6 to fix the toner image, and then the sheet S is discharged to the outside of a main body of the image forming apparatus. Residual transfer toner remaining on the intermediate transfer belt 51 after the secondary transfer is removed by an intermediate transfer member cleaner 7 for the next image forming operation.

The image forming apparatus 100 of the present embodiment can form a single color image such as a black image or a multicolor image by using the image forming portions for one or more of four colors.

Figure 2:
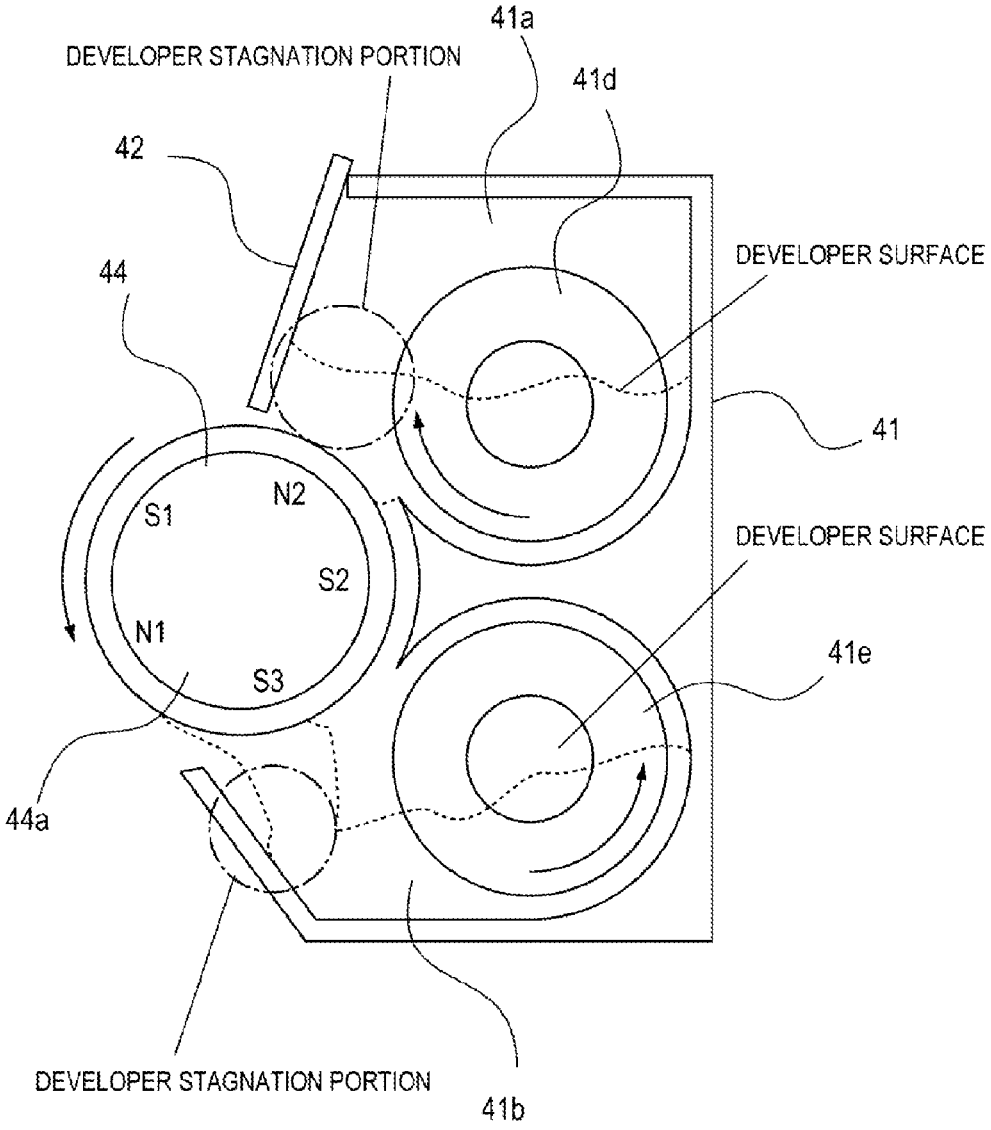
FIG. 2 is a configuration diagram of a developing device according to the first embodiment.
Figure 3A:
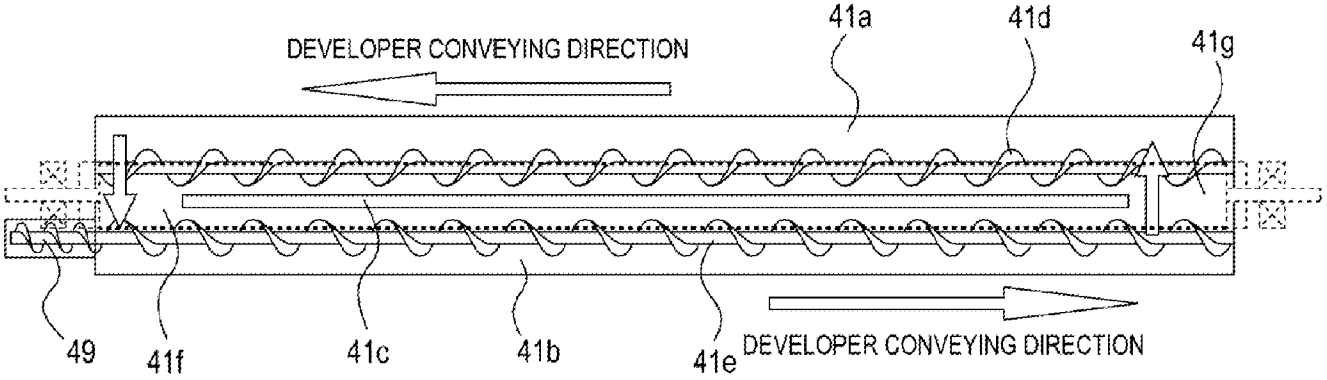
FIGS. 3A and 3B are diagrams illustrating a circulation path of developer in the developing device according to the first embodiment.
Figure 3B:
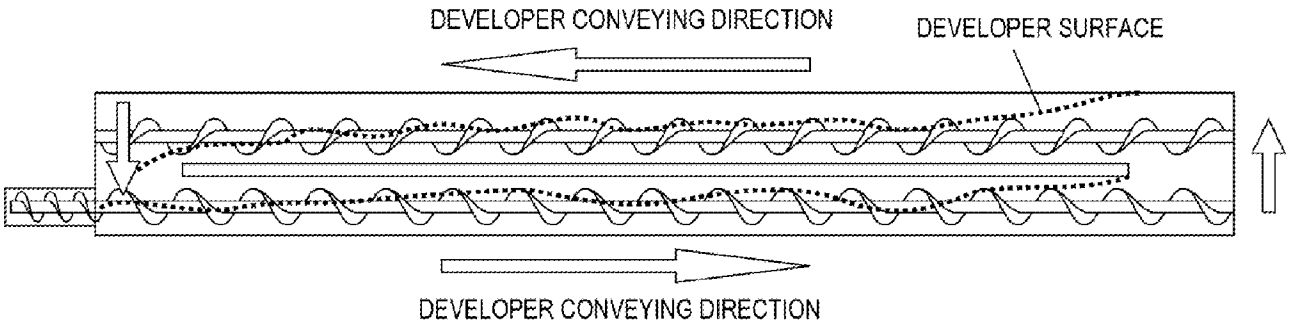

(Developing Device 4) FIG. 2 is a configuration diagram of the developing device 4 according to the present embodiment. FIGS. 3A and 3B are diagrams illustrating a circulation path of developer formed by conveying units (first conveying screw 41*d* and second conveying screw 41*e*).

As illustrated in FIGS. 2, 3A, and 3B, the developing device 4 includes a developing container 41, conveying screws 41*d* and 41*e*, a developing blade (developer regulating member) 42, a developing sleeve (developer bearing member) 44, and a magnet roller (magnetic field generating unit) 44*a*.

The developing container 41 contains two-component developer having nonmagnetic toner and a magnetic carrier. The inside of the developing container 41 is vertically divided by a longitudinally extending partition wall 41*c* into a developing chamber 41*a* serving as a developer conveying path and an agitating chamber 41*b* also serving as the developer conveying path.

A scooping portion 41*g* is provided on a longitudinal end (right side in FIGS. 3A and 3B) of the developing container 41 for scooping developer from the agitating chamber 41*b* to the developing chamber 41*a*. A falling portion 41*f* is provided on the other longitudinal end (left side in FIGS. 3A and 3B) of the developing container 41 for allowing developer to fall from the developing chamber 41*a* to the agitating chamber 41*b*.

The first conveying screw (first conveying unit) 41*d* is disposed in the developing chamber 41*a*. The second conveying screw (second conveying unit) 41*e* is disposed in the agitating chamber 41*b*. The conveying screws 41*d* and 41*e* are vertically arranged at upper and lower sides and are parallel to each other. The conveying screws 41*d* and 41*e* convey developer in opposition directions along a rotational axis of the developing sleeve 44. Therefore, the developer is circulated and conveyed along a circulation path in the developing container 41 via the falling portion 41*f* and the scooping portion 41*g*. In addition, the second conveying screw 41*e* agitates toner supplied from a developer supply port 49 together with the developer already existing in the agitating chamber 41*b*, and supplies the agitated toner and developer, thereby stabilizing the toner density.

The developing sleeve 44 is made of a nonmagnetic material, and in a developing operation, the developing sleeve 44 rotates in the direction of an arrow shown in FIG. 2. The magnet roller 44*a* includes a magnet fixed to the inside of the developing sleeve 44 and having magnetic flux density peaks at five poles (N1, S1, N2, S2, and S3).

The developing chamber 41*a* of the developing device 4 is opened at a position corresponding to a developing region facing the photosensitive drum 1, and the developing sleeve 44 is rotatably disposed at the opened position of the developing container 41 in a state where the developing sleeve 44 is partially exposed.

The developer is supplied to the developing sleeve 44 from the inside of the developing chamber 41*a* by the first conveying screw 41*d*. A predetermined amount of the developer supplied to the developing sleeve 44 is held on the developing sleeve 44 by the magnetic pole N2 of the magnet roller 44*a*, thereby forming a developer stagnation portion. As the developing sleeve 44 rotates, two-component developer on the developing sleeve 44 passes through the developer stagnation portion and is regulated in thickness by the developing blade 42, and is then conveyed to the developing region facing the photosensitive drum 1 by the magnetic poles S1 and N1. In the developing region, the developer on the developing sleeve 44 stands like plant ears to form a magnetic brush.

The magnetic brush is brought into contact with the photosensitive drum 1 to supply toner of the developer to the photosensitive drum 1 for developing the electrostatic latent image of the photosensitive drum 1 into a toner image. In addition, so as to improve developing efficiency, a developing bias voltage in which direct voltage and alternating voltage are superimposed is applied to the developing sleeve 44 from a developing bias power source which serves as a voltage application unit.

After toner is supplied to the photosensitive drum 1, the developer is returned to the developing chamber 41*a* from the developing sleeve 44 as the developing sleeve 44 is further rotated. After developing, toner is stripped from the developing sleeve 44 and is collected in the agitating chamber 41*b* by repelling like poles S2 and S3 disposed between the developing chamber 41*a* and the agitating chamber 41*b*. At this time, the stripped developer stagnates at the magnetic poles S3 to form a developer stagnation portion.

(Problems with function separation and vertical agitation type developing device of the related art) As illustrated in FIG. 3B, in a function separation and vertical agitation type developing device, the developer distribution is generally as follows: the amount of developer is large at the scooping portion 41*g* and is small at the falling portion 41*f* opposite to the scooping portion 41*g*. Therefore, if the amount of developer at the scooping portion increases as the amount or fluidity of the developer is varied according to durability deterioration of the developer, T/D (weight ratio of toner/developer) control, auto carrier refresh (ACR), or the like, the amount of the developer becomes excessive between the developing sleeve 44 and the scooping portion 41*g*. Here, the term ACR (Auto Carrier Refresh) means a control operation for increasing the lifespan of developer by supplying and discharging a carrier.

Therefore, a corotation phenomenon occurs in which developer is not stripped off by a repelling force but is supplied again for the next developing process. Then, tints vary because of variation of the amount of developer on the developing sleeve 44 or T/D variation.

Figure 4:
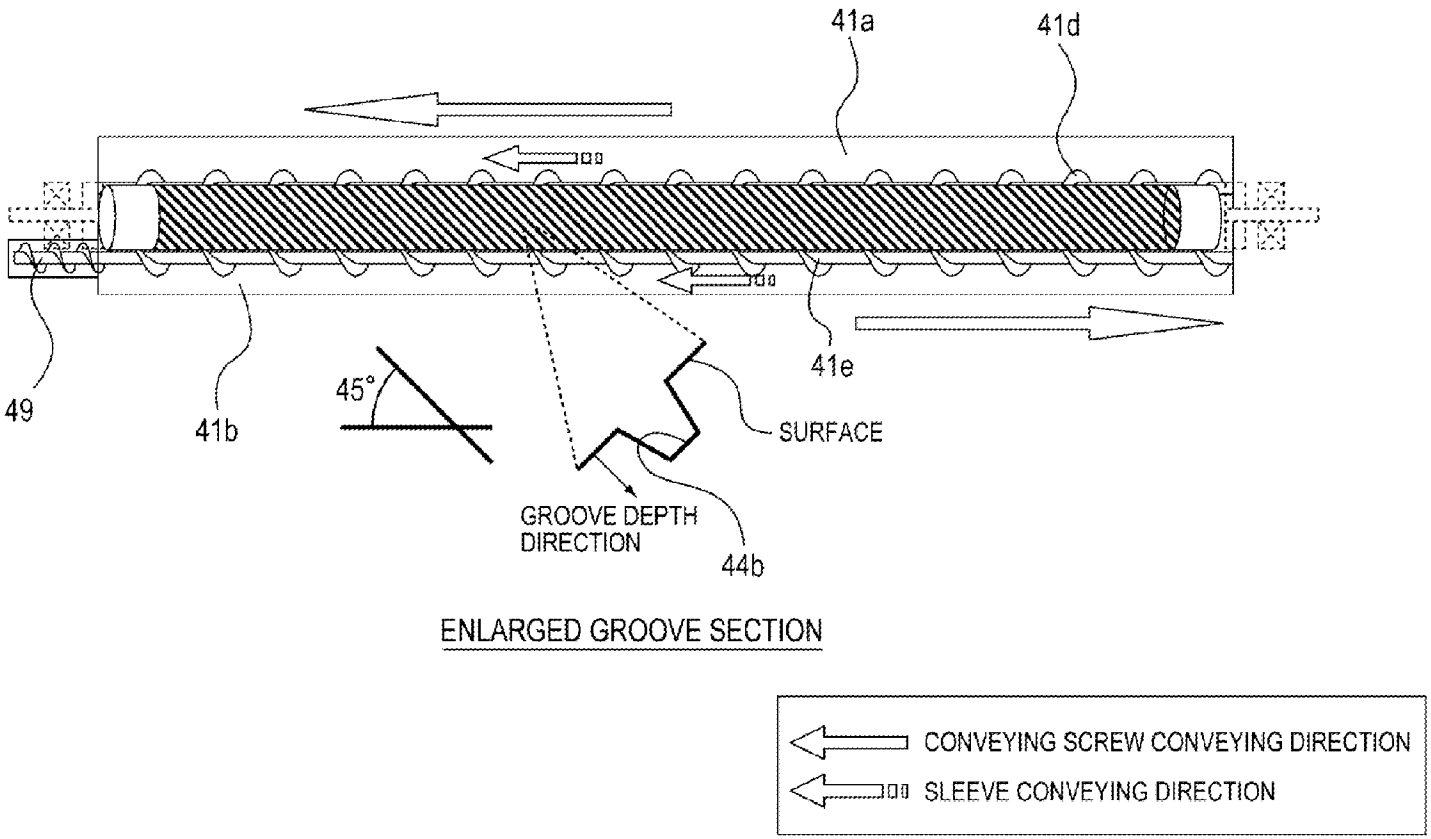
FIG. 4 is a configuration diagram of a developing sleeve according to the first embodiment.

(Developing sleeve 44) In the present embodiment, a spiral groove 44*b* is formed on the surface of the developing sleeve 44 to prevent the corotation phenomenon. FIG. 4 is a configuration diagram of the developing sleeve 44 according to the present embodiment. As illustrated in FIG. 4, the groove 44*b* is formed on the surface of the developing sleeve 44. The groove 44*b* has a spiral shape making an angle of 45° relative to a rotational axis (longitudinal direction) of the developing sleeve 44. The groove 44*b* has a pitch of 750 μm in the longitudinal direction of the developing sleeve 44.

In a region facing the developing sleeve 44, the developer is conveyed from the developing chamber 41*a* to the agitating chamber 41*b* by rotating the developing sleeve 44. In addition, the developer is conveyed in the same direction as that in which the first conveying screw 41*d* of the developing chamber 41*a* conveys the developer. At this time, in the agitating chamber 41*b*, the developer conveying direction of the second conveying screw 41*e* is opposite to a direction in which the developer is conveyed by the groove 44*b* along the length of the developing sleeve 44. That is, the spiral groove 44*b* is formed on the surface of the developing sleeve 44 in a manner such that the groove 44*b* applies a conveying force to the developer in a rotational axis direction of the developing sleeve 44 opposite to the developer conveying direction of the agitating chamber 41*b*.

As illustrated in FIG. 2, the developer is blocked by the developing blade 42 at the magnetic pole N2 so that conveying of the developer is suppressed in a circumferential direction. In addition, the developer is blocked at the magnetic pole S3 by a repelling force between the magnetic poles S2 and S3 so that conveying of the developer is suppressed in a circumferential direction. In this way, the developer stays at a position N2 or S3 for a predetermined period of time, and thus the amount of the developer is increased. Therefore, owing to magnetic forces of the magnetic poles N2 and S3 acting in directions normal to the surface of the developing sleeve 44, large adsorption forces is obtained in directions toward the inside of the developing sleeve 44. Accordingly, a developer conveying force is easily affected by the groove shape.

As a result, a conveying force for conveying the developer on the developing sleeve 44 in the longitudinal direction of the developing sleeve 44 becomes large at the developer stagnation portions (magnetic poles N2 and S3). In this way, the developer can be conveyed to the falling portion 41*f* from the vicinity of the scooping portion at which the corotation phenomenon easily occurs, and thus the developer can be properly distributed in the developing container 41.

At positions other than the developer stagnation portions, the developer is conveyed along the entire surface of the developing sleeve 44 including ridges and furrows of the groove shape without staying at one position for a predetermined period of time, and thus a force for conveying the developer tends to become small in the longitudinal direction.

Figure 8:
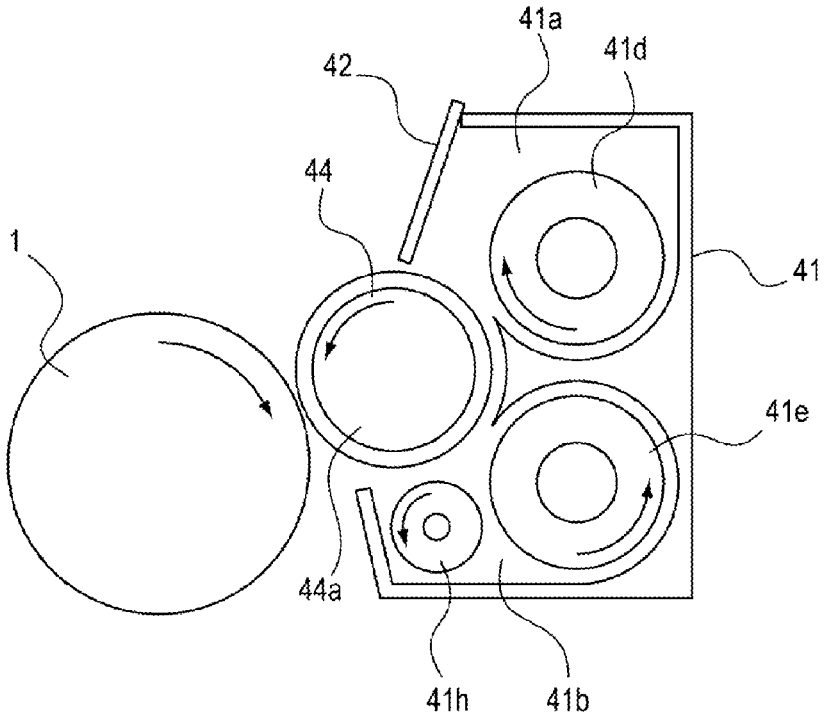
FIG. 8 PRIOR ART
FIG. 8 is a configuration diagram of a function separation and vertical agitation type developing device of the related art.
Figure 9:
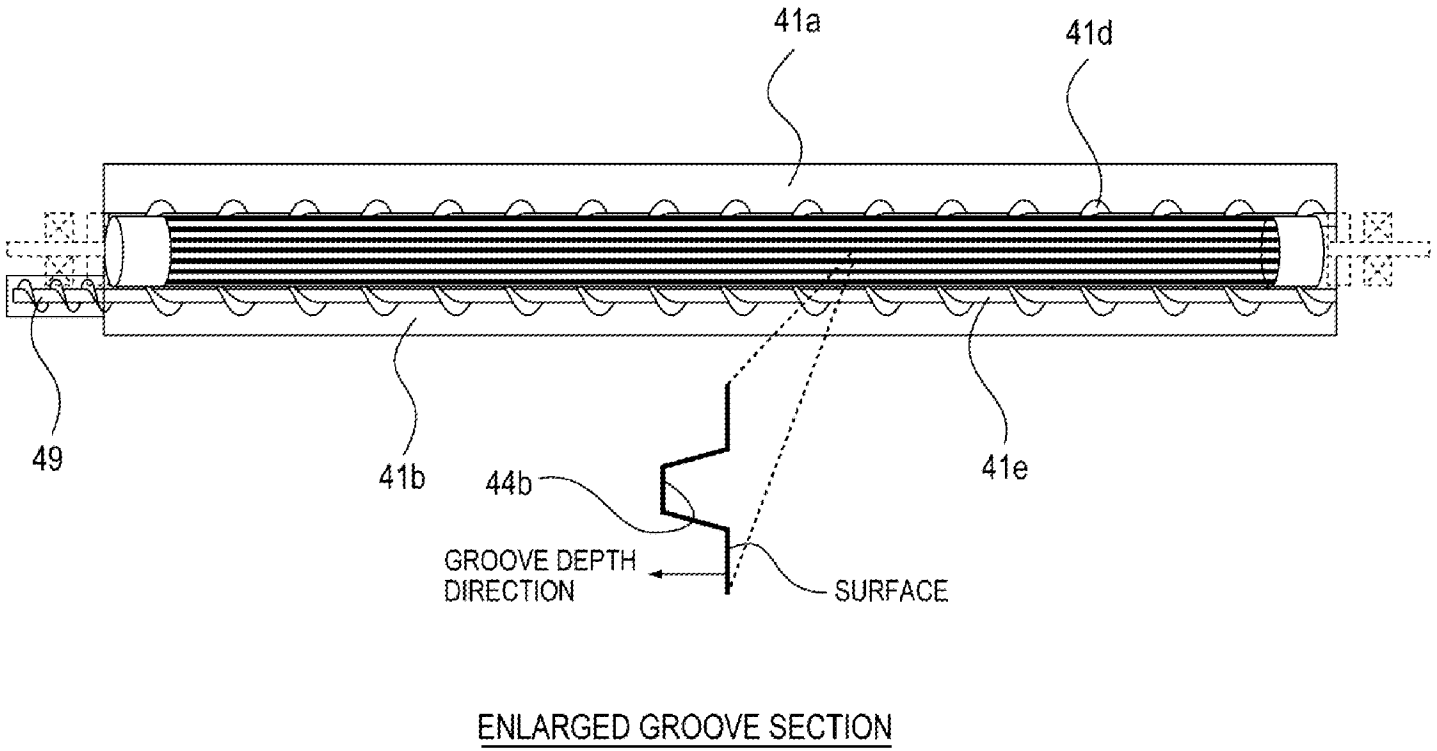
FIG. 9 PRIOR ART
FIG. 9 is a configuration diagram of a developing sleeve of the related art.

(Verification) The level of the corotation phenomenon was checked in the configuration of the related art (refer to FIGS. 8 and 9) and the configuration of the present embodiment (refer to FIGS. 2 and 4). For the verification, new developer and durable developer used for forming 5%-duty images on 100,000 sheets were used. In the verification, an image forming apparatus of the related art and the image forming apparatus of the present embodiment were used, and a halftone image (hereinafter referred to as an HT image) having a density of 60% with respect to a solid image was formed to determine whether density nonuniformity occurred by the corotation phenomenon when developer was supplied.

When the new developer was used, the corotation phenomenon did not occur both in the configuration of the related and the configuration of the present embodiment, and satisfactory results were obtained in terms of density uniformity. When the durable developer was used in the configuration of the related, the corotation phenomenon was detected over 30 mm from the scooping portion side, and density nonuniformity was detected. However, in the configuration of the present embodiment, the corotation phenomenon and density nonuniformity were not detected.

In the case of using the durable developer, the fluidity of the developer is lowered by aging, and the amount of developer stagnating at the magnetic pole S3 is large. However, according to the present embodiment, the spiral groove 44*b* of the developing sleeve 44 increases the amount of developer conveyed in a direction opposite to the direction in which the developer is conveyed by the second conveying screw 41*e*, thereby suppressing the corotation phenomenon. Furthermore, in the configuration of the related art, if the amount of developer increases at the scooping portion and the amount of developer stagnating at the magnetic pole S3 increases, the amount of developer falling to a return screw 41*h* locally increases. In this case, the amount of developer splattered upward by the return screw 41*h* increases to cause the corotation phenomenon.

As described above, according to the configuration of the present embodiment, although the fluidity of developer decreases, the corotation phenomenon can be suppressed, and it is possible to prevent stripped developer from flowing back to the developing screw. That is, tint variation caused by the corotation phenomenon can be decreased, and high image and product qualities can be maintained over the entire product lifespan.

Incidentally, in the present embodiment, the angle of the spiral groove 44*b* is not limited to 45°. It is only required that the corotation phenomenon can be prevented and the developer can be conveyed from the vicinity of the scooping portion to the falling portion 41*f*. In the present embodiment, when the angle of the spiral groove 44*b* ranges from 20° to 70°, the effect of reducing the corotation phenomenon can be obtained compared with the configuration of the related art.

Furthermore, although a vertical agitation type developing device is described in the present embodiment, the present invention is not limited to the vertical agitation type developing device. That is, the present invention can be applied to other developing devices such as a function separation and horizontal agitation type developing device.

[Second Embodiment] A second embodiment of a developing device and an image forming apparatus according to the present invention will be described with reference to the drawings. Parts overlapping with those described in the first embodiment are denoted by the same elements, and descriptions thereof are not repeated.

Figure 5:
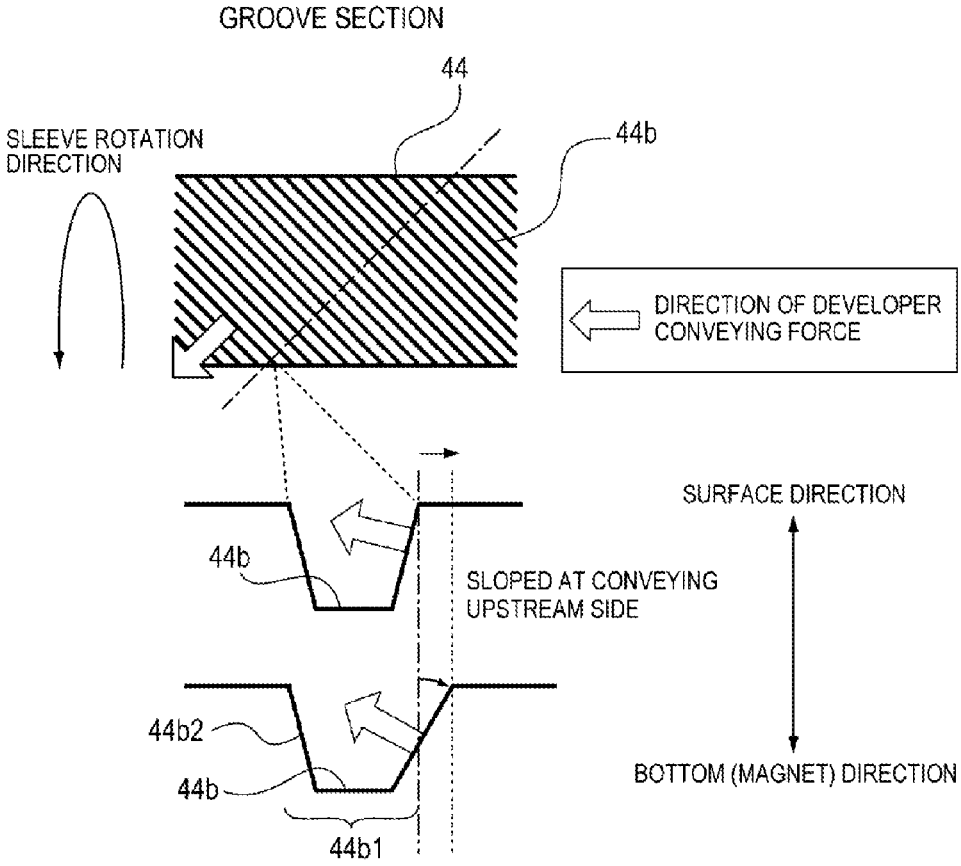
FIG. 5 is a configuration diagram of a groove shape according to a second embodiment.

FIG. 5 is a configuration diagram of a groove 44*b* according to the present embodiment. As illustrated in FIG. 5, in a developing device 4 and an image forming apparatus 100 of the present embodiment, the groove 44*b* of the developing sleeve 44 included in the developing device 44 and the image forming apparatus 100 of the first embodiment is modified in shape.

Like the groove 44*b* of the first embodiment, the groove 44*b* of the present embodiment has a spiral shape and is tapered toward the bottom surface at a predetermined angle. The groove 44*b* includes a concave portion 44*b*1 as a groove bottom surface and a ridge surface portion 44*b*2. The ridge surface portion 44*b*2 is a lateral side sloped from the surface of the developing sleeve 44 to the concave portion 44*b*1.

In the groove 44*b* of the present embodiment, the ridge surface portion 44*b*2 is more sloped down at an upstream side in a developer conveying direction (at an upstream side in the rotation direction of the developing sleeve 44), as compared with the groove 44*b* of the first embodiment. The ridge surface portion 44*b*2 presses the developer at an upstream side in a rotation direction. Thus, if the angle of the ridge surface portion 44*b*2 increases, a developer conveying force increases because developer slipping reduces, and if the angle of the ridge surface portion 44*b*2 decreases, the developer conveying force decreases because developer slipping increases.

Figures 6A, 6B, 6C:
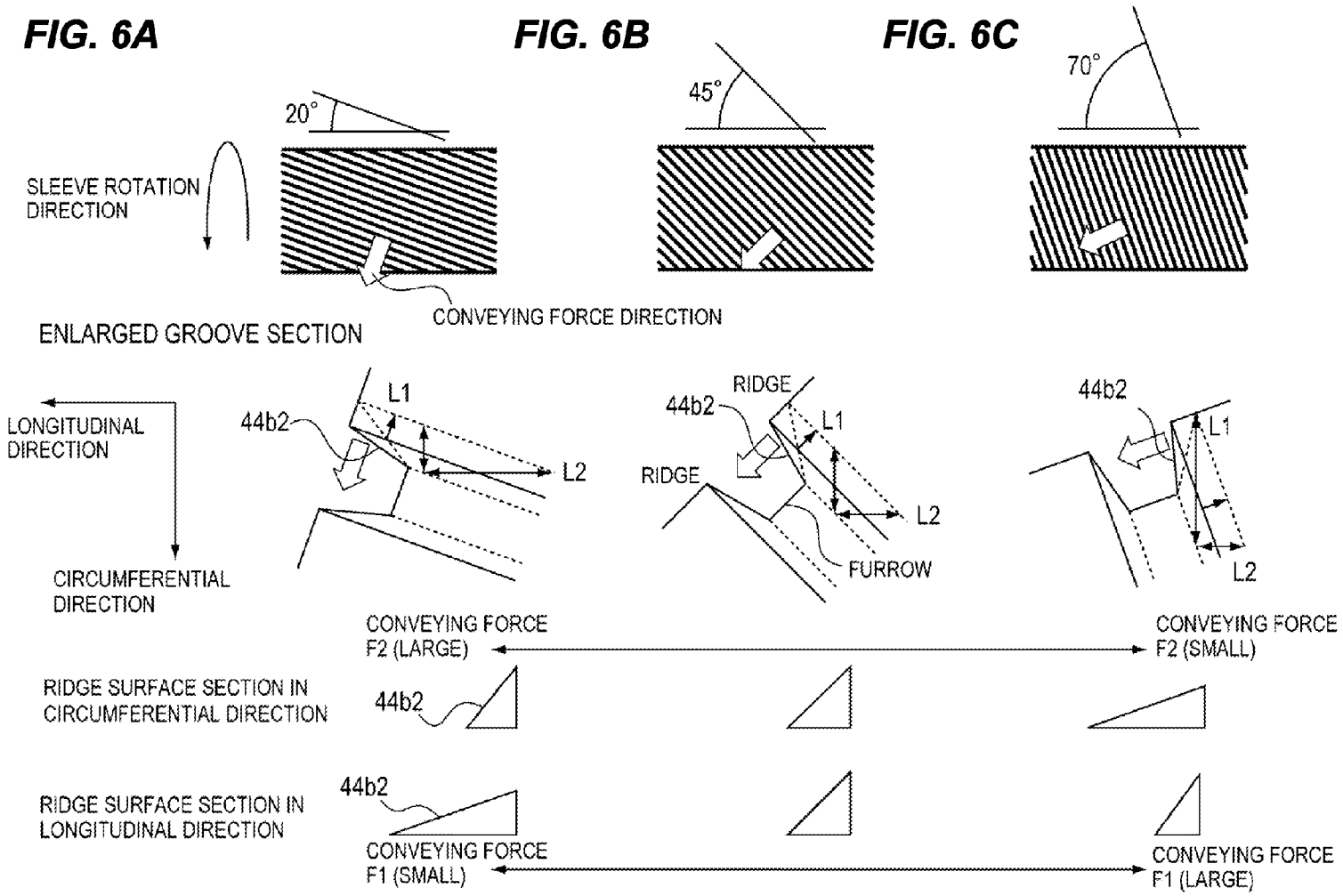
FIGS. 6A, 6B, and 6C are diagrams illustrating different angles of a groove with respect to a longitudinal direction according to the second embodiment.

FIGS. 6A to 6C are diagrams illustrating different angles of the groove 44*b* with respect to a longitudinal direction. In each of the FIGS. 6A to 6C, the upper section is a schematic view illustrating the surface of the developing sleeve, the middle section is an enlarged view illustrating the groove, and the lower section is a view illustrating the angle of the ridge surface portion 44*b*2 at the upstream side in the rotation direction.

As illustrated in the upper and middle sections of FIGS. 6A to 6C, the ratio of a circumferential length L1 to a longitudinal length L2 of the ridge surface portion 44*b*2 is changed by varying the angle of the groove 44*b* in the longitudinal direction. In this way, a conveying force F1 in the longitudinal direction and a conveying force F2 in the circumferential direction can be changed by varying the direction of a conveying force (denoted by a thick arrow in FIGS. 6A to 6C).

In the present embodiment, the angle of the groove 44*b* may be set to a range of 45° to 70° with respect to the longitudinal direction of the developing device, so as to increase the circumferential length L1 of the ridge surface portion 44*b*2 as compared with the first embodiment. In this way, a large longitudinal conveying force F1 can be applied to a developer stagnation portion.

In addition, together with the configuration in which the angle of the ridge surface portion 44*b*2 is decreased at an upstream side in a conveying direction, as illustrated by dashed lines in the middle sections of FIGS. 6A to 6C, a smaller conveying force F2 can be applied in the circumferential direction of the ridge surface portion 44*b*2, and a large longitudinal conveying force F1 can be applied.

(Verification) The level of the corotation phenomenon was checked in the configuration of the related art (refer to FIGS. 8 and 9), the configuration of the first embodiment (refer to FIGS. 2 and 4), and the configuration of the present embodiment (refer to FIG. 5). For the verification, durable developer used for forming 5%-duty images on 100,000 sheets and 1%-duty images on 10,000 sheets was used.

In the verification, image forming apparatuses of the related art, the first embodiment, and the present embodiment were used, and a halftone image (hereinafter referred to as an HT image) having a density of 60% with respect to a solid image was formed. Then, it was checked whether density nonuniformity occurred by the corotation phenomenon when the developer was supplied.

In the configuration of the related art, the corotation phenomenon was detected over 50 mm from a scooping portion side, and in the configuration of the first embodiment, the corotation phenomenon was detected over 20 mm from a scooping portion side. Density nonuniformity was detected in both the configurations. However, in the configuration of the present embodiment, the corotation phenomenon and density nonuniformity were not detected.

As described above, according to the present embodiment, although the fluidity of developer was further lowered, the corotation phenomenon was suppressed as compared with the first embodiment. Thus, tint variation caused by the corotation phenomenon can be decreased, and high image and product qualities can be maintained over the entire product lifespan.

Furthermore, if the angle of the groove 44*b* is 70° or more with respect to the longitudinal direction of the developing sleeve, since the pitch of the spiral groove corresponding to one turn of the sleeve is short, the conveying velocity in the longitudinal direction can be noticeably reduced. Therefore, the corotation phenomenon gradually occurred over about 10 mm from the scooping side, resulting density nonuniformity.

In addition, a decrease in M/S (developer weight per unit area) on the developing sleeve caused by a decrease in circumferential conveying force can be compensated for by increasing the depth of the groove 44*b* or decreasing the pitch of the groove 44*b*. In this way, the longitudinal conveying force can be increased with respect to the circumferential conveying force. Therefore, since the longitudinal conveying force can be increased at a developer stagnation portion, the corotation phenomenon at the scooping portion can be suppressed.

In addition, the amount of developer may be decreased at a developing region facing the photosensitive drum 1 due to a decrease in the circumferential conveying force. However, this can be overcome by properly adjusting the gap (S-B gap) between the developing blade 42 and the developing sleeve 44.

[Third Embodiment] A third embodiment of a developing device and an image forming apparatus according to the present invention will be described with reference to the drawings. Parts overlapping with those described in the first embodiment are denoted by the same reference numerals, and descriptions thereof will not be repeated.

Figure 7:
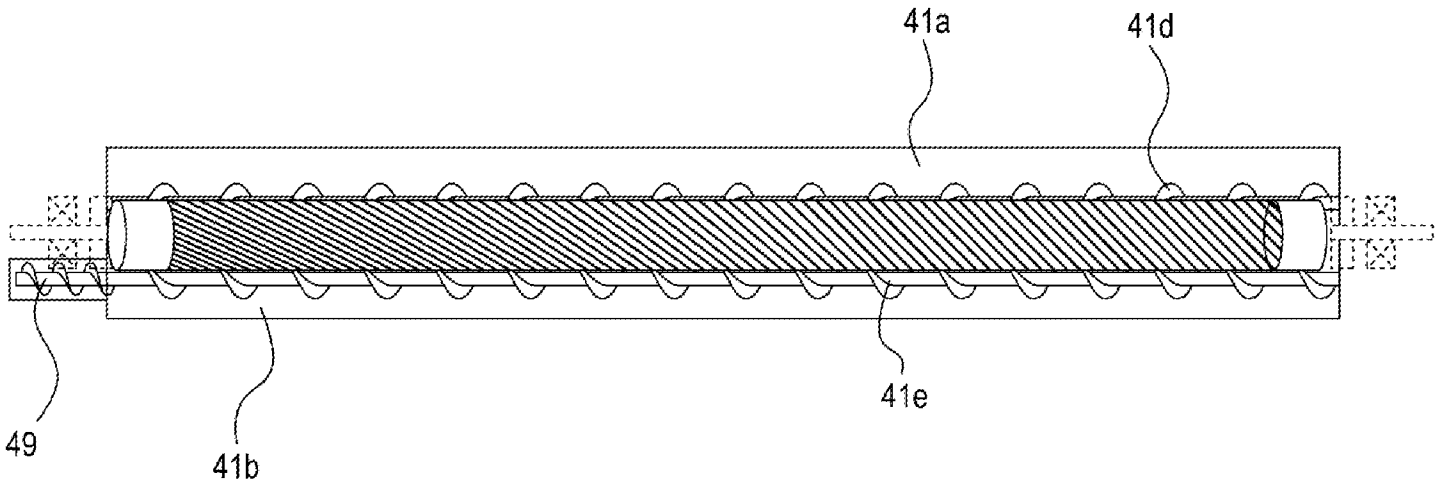
FIG. 7 is a configuration diagram of a groove shape according to the second embodiment.

FIG. 7 is a configuration diagram of a groove 44*b* according to the present embodiment. As illustrated in FIG. 7, in a developing device 4 and an image forming apparatus 100 of the present embodiment, the groove 44*b* of the developing sleeve 44 included in the developing device and the image forming apparatus 100 of the first embodiment is modified in shape.

Since the groove 44*b* having a spiral shape is formed on the surface of the developing sleeve 44, a longitudinal conveying force is large, and a large developer stagnation portion is formed at an end in a longitudinal direction. Therefore, as the durability of developer decreases, the developer may not be stripped off but some of the developer may corotate.

Therefore, in the present embodiment, as illustrated in FIG. 7, the angle of the spiral groove 44*b* with respect to the longitudinal direction of the developing sleeve is gradually decreased toward a downstream side in a conveying direction. In the present embodiment, the angle of the groove 44*b* with respect to the longitudinal direction is 45° in a region from a longitudinal upstream side of the developing sleeve 44 to a longitudinal center of an image forming region, and is then decreased from the longitudinal center toward a longitudinal downstream side. The angle of the groove 44*b* is 20° at a longitudinal downstream end.

If the angle of the groove 44*b* decreases, M/S (developer weight per unit area) on the developing sleep increases. Therefore, the depth of the groove 44*b* is reduced according to the angle of the groove 44*b* so as to keep the value of M/S constant. Specifically, in a region where the angle of the groove 44*b* is 45°, the depth of the groove 44*b* is set to 80 μm, and at the part where the angle of the groove 44*b* is 20°, the depth of the groove 44*b* is set to 40 μm. Then, in an intermediate region therebetween, the depth of the groove 44*b* is linearly reduced.

This increases a circumferential conveying force (developer stripping force) at the longitudinal end, reduces a conveying force in the longitudinal direction, and largely reduces the corotation phenomenon at both ends of the developing sleeve (a scooping part side and an opposite side thereto). Therefore, although the fluidity of developer decreases, the corotation phenomenon can be suppressed at both ends of the developing sleeve, tint variation caused by the corotation phenomenon can be decreased, and high image and product qualities can be maintained over the entire product lifespan.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-002195, filed Jan. 10, 2012, which is hereby incorporated by reference herein in its entirety.

What is claimed is:

1. A developing device comprising:

a developer bearing member which bears developer and conveys the developer to a developing region;

a developing chamber which faces the developer bearing member to supply the developer to the developer bearing member;

an agitating chamber which forms a circulation path with the developing chamber and faces the developer bearing member to collect the developer from the developer bearing member;

a conveying member which circulates and conveys the developer in the circulation path; and a spiral groove which is formed on a surface of the developer bearing member, wherein the spiral groove is helically formed in a direction such that, when the developer bearing member is rotated, the developer borne on the developer bearing member receives a conveying force in a rotational axis direction of the developer bearing member opposite to a developer conveying direction of the agitating chamber.

2. The developing device according to claim 1, wherein the groove has a concave shape, and a lateral side of the concave shape located at an upstream side in a rotational direction of the developer bearing member is sloped so that the concave shape narrows toward a bottom surface.

3. The developing device according to claim 1, wherein an angle between the spiral groove and a rotational axis of the developer bearing member is 20° to 70°.

4. The developing device according to claim 1, wherein an angle between the spiral groove and a rotational axis of the developer bearing member decreases toward a downstream side in the developer conveying direction of the agitating chamber.

5. An image forming apparatus comprising:

an image bearing member which bears an electrostatic latent image on a surface thereof; and the developing device of claim 1 which develops the electrostatic latent image formed on the image bearing member using developer.

6. The developing device according to claim 1, wherein the conveying member includes a first conveying screw supported and circulating in the developing chamber and a second conveying screw supported and circulating in the agitating chamber.

* * * * *